United States Patent [19]

Nishioka et al.

[11] 4,353,217

[45] Oct. 12, 1982

[54] DIRECT CONTACT TYPE MULTI-STAGE STEAM CONDENSER SYSTEM

[75] Inventors: Ryozo Nishioka; Yoshihiro Kizawa; Hiroshi Shingai, all of Kawasaki, Japan

[73] Assignee: Fuji Electric Co., Ltd., Kanagawa, Japan

[21] Appl. No.: 118,713

[22] Filed: Feb. 5, 1980

[30] Foreign Application Priority Data

Feb. 23, 1979 [JP] Japan ..... 54-19176

[51] Int. Cl.[3] ..... F28B 7/00

[52] U.S. Cl. ..... 60/693; 60/690; 261/110; 165/110

[58] Field of Search ..... 60/685, 688, 690, 693; 261/DIG. 10, DIG. 11, DIG. 32, 110, 111; 165/110, 114

[56] References Cited

U.S. PATENT DOCUMENTS 2,927,428 3/1960 Sala ..... 60/688 X
3,596,888 8/1971 Heller et al. ..... 261/DIG. 11
4,063,418 12/1977 Shields ..... 60/688
4,156,349 5/1979 Silvestri, Jr. ..... 60/693 X

*Primary Examiner*—Allen M. Ostrager
*Assistant Examiner*—Stephen F. Husar
*Attorney, Agent, or Firm*—Sughrue, Mion, Zinn, Macpeak and Seas

[57] ABSTRACT

A direct contact type multi-stage steam condenser system having a direct contact type high vacuum stage steam condenser disposed above a low vacuum stage steam condenser with a water supplying tank for the low vacuum stage condenser disposed therebetween. In the preferred embodiment, the high and low vacuum stage condensers and the water supplying tank are formed integrally as a single unit. The water supplying tank, which also serves as a gas-tight seal between the condenser stages, is formed above a water sprinkling board provided in the upper portion of the low vacuum stage condenser. Condensed water falls under its own weight thereby eliminating the need for an intermediate pressurizing pumps.

7 Claims, 2 Drawing Figures

DIRECT CONTACT TYPE MULTI-STAGE STEAM CONDENSER SYSTEM

BACKGROUND OF THE INVENTION

The present invention relates to a direct contact type multiple pressure stage steam condenser system which is suitable for a geothermal turbine plant.

A technique in which a multiple pressure stage steam condenser system is formed by supplying, in a series mode, cooling water to a plurality of steam condensers and in which the cooling power of the cooling water is effectively utilized thereby to improve the thermal efficiency of a turbine plant is well known in the art and is currently employed for heat power plants.

However, for the aforementioned geothermal turbine plant, it is often difficult to obtain a sufficient amount of cooling water because of local conditions at the plant. Therefore, a technique in which a cooling tower is provided to recirculate the cooling water has been extensively employed in such geothermal turbine plants. In this case, in view of economical considerations including the cost of installing and operating the cooling tower, the temperature rise of the cooling water in the steam condensers is, in general, selected to be higher than that for a technique in which the used cooling water is simply discharged as for surface type steam condensers in a conventional heat power plant. Accordingly, for a geothermal turbine plant using cooling water under such concitions, employment of a multiple pressure stage steam condenser system is effective and advantageous for improving thermal efficiency. In addition, a geothermal turbine typically employs direct contact type steam condensers because recovery of the condensate is unnecessary in order to eliminate corrosion and contamination of heat transferring surfaces due to impurities contained in geothermal steam.

FIG. 1 shows an example of a conventional multiple pressure stage steam condenser system which combines a plurality of direct contact type steam condensers as described above. The multiple pressure stage steam condenser system includes a geothermal steam supplying pipe 1, a turbine inlet valve 2, a double-flow turbine 3, a generator 4, a high vacuum stage steam condenser 5, a low vacuum stage steam condenser 6, a cooling water supplying pipe 7, a cooling water discharging pipe 8, a series connection pipe connected between the hot well of the steam condenser 5 and the cooling water supplying inlet of the steam condenser 6, pumps 10 and 11, gas extracting pipes 12 connected to the steam condensers 5 and 6 for extracting non-condensable gas therefrom, and vacuum pumps 13 for extracting gas.

The steam supplying pipe 1 is coupled to a steam well 14. The cooling water pipes 7 and 8 are connected to a cooling tower 15. The two direct contact type steam condensers 5 and 6, which are independent of one another, are juxtaposed as shown in FIG. 1. The steam condensers 5 and 6 are coupled to the discharge side of the double-flow turbine 3 and are coupled to each other through the series pipe 9 and the pump 10 thus forming a multiple pressure stage steam condenser system having two stages, namely, high and low vacuum stages.

The operation of the multiple pressure stage steam condenser system thus constructed will be briefly described. Water cooled by the cooling tower 15 is supplied through the cooling water supplying pipe 7 to the high vacuum stage steam condenser 5 to condense steam discharged through one of the steam discharging outlets of the turbine 3. The mixture of the cooling water and the condensate pooled in the hot well of the steam condenser 5, which is pressurized by the pump 10, is supplied to the low vacuum stage steam condenser 6 to condense steam discharged through the other steam discharging outlet of the turbine 3. The water pooled in the hot well of the steam condenser 6 is returned through the pump 11 to the cooling tower 15 where it is cooled to be supplied again. In this manner, the water is circulated. Non-condensable gas separated in the steam condensers 5 and 6 is extracted and discharged by the vacuum pumps 13 so as to maintain high pressure in the steam condensers.

In the above-described conventional direct contact type multiple pressure stage steam condenser system, in order to supply as cooling water the mixture of the condensate pooled in the hot well of the high vacuum stage steam condenser 5 and the cooling water to the low vacuum stage steam condenser 6, it is necessary to compensate the difference between the pressures of the two steam condensers 5 and 6. That is, it is necessary to further pressurize the mixture by the pump 10. Thus, because power is required for operating the pump 10, the total power consumption is increased. In addition, the total cost of equipment such as pumps, control devices and security devices is increased. This in turn reduces the economical effect of employing a multi-stage steam condenser system.

SUMMARY OF THE INVENTION

Accordingly, an object of the invention is to eliminate all of the above-described difficulties accompanying a conventional multiple pressure stage steam condenser system.

More specifically, an object of the invention is to provide an advantageous direct contact type multiple pressure stage steam condenser system the arrangement of which is determined so as to eliminate the intermediate pressurizing pump which is required by the conventional multiple pressure stage steam condenser system so as to simplify the construction, to reduce the space required for the installation, to decrease the cost of equipment, and to reduce the cost of operation.

The foregoing object and other objects of the invention have been achieved by the provision of a direct contact type multiple pressure stage steam condenser system which includes a direct contact type high vacuum stage steam condenser and a direct contact type low vacuum stage steam condenser which are coupled to the steam discharge outlets of a steam turbine and which are series-connected in such a manner that the high vacuum stage steam condenser is above the low vacuum stage steam condenser and that cooling water is supplied into the upper steam condenser and is discharged from the lower steam condenser. The system further includes a water supplying tank for the low steam condenser, the water supplying tank being disposed between the upper and lower steam condensers in such a manner that the mixture of condensate formed in the high vacuum stage steam condenser and the cooling water drops into the water supplying tank and is supplied into the low vacuum stage steam condenser and that the water pooled in the water supply tank serves as sealing means providing a gas-tight separation between the high and low vacuum stage steam condensers.

The nature, principle and utility of the invention will become more apparent from the following detailed description with the accompanying drawing.

DESCRIPTION OF THE PREFERRED EMBODIMENTS

Figure 2:
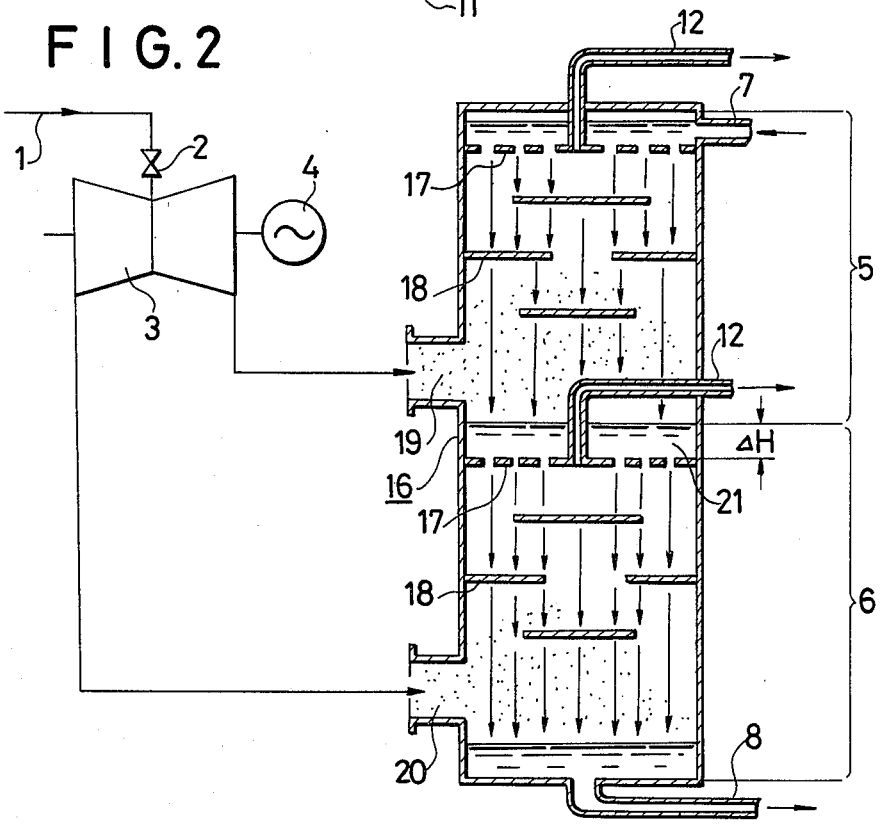
FIG. 2 is an explanatory diagram, partly as a sectional diagram, showing a preferred embodiment of a multiple pressure stage steam condenser system according to the invention.

The invention will be described with reference to its preferred embodiment shown in FIG. 2. In FIG. 2, reference numeral 16 designates a common steam condenser barrel 16 in the form of a single unit which is provided for a direct contact type multiple pressure stage steam condenser system according to the invention. The upper part and the lower part of the barrel 16 are occupied by a high vacuum stage steam condenser 5 and a low vacuum stage steam condenser 6, respectively. The high vacuum stage steam condenser 5 has a porous or a water sprinkling board 17 in its upper region and trays 18 disposed below the water sprinkling board 17. The trays 18 are staggered as shown in FIG. 2. The steam condenser 5 further includes a water supplying pipe 7 debouching above the water sprinkling board 17 and a non-condensable gas discharging pipe 12 which extends through the water sprinkling board 17 and the ceiling of the barrel 16. Furthermore, a steam inlet 19 opens into the lower part of the side wall of the steam condenser 5.

The low vacuum stage steam condenser 6 below the high vacuum stage steam condenser 5 has a water sprinkling board 17 and trays 18 in the upper region thereof similar to the high vacuum stage steam condenser 5. A non-condensable gas discharging pipe 12 extends from the water sprinkling board 17 and a water discharging pipe 8 extends from the hot well at the bottom of the steam condenser 6. Furthermore, a steam inlet 20 opens into the lower part of the side wall of the steam condenser 6.

A water supplying tank 21 for the steam condenser 6 is formed on top of the water sprinkling board 17 of the steam condenser 6 which serves also as the hot well of the high vacuum stage steam condenser 6 positioned above the low vacuum stage steam condenser 5.

Figure 1:
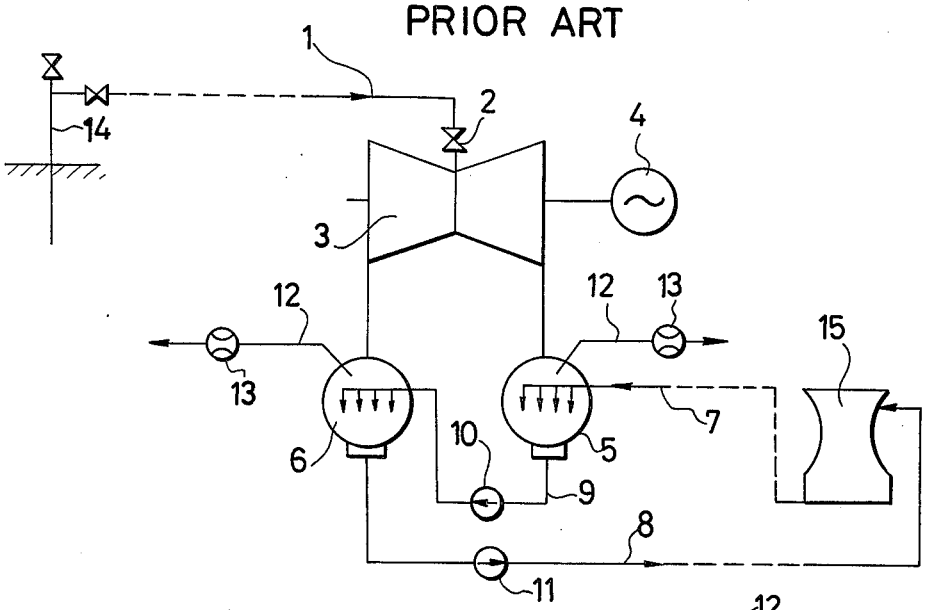
FIG. 1 PRIOR ART
FIG. 1 is an explanatory diagram showing the arrangement of a conventional multiple pressure stage steam condenser system.

In the embodiment described above, the steam condensers 5 and 6 are provided in a single common barrel. However, the multiple pressure stage steam condenser system of the invention can be implemented by positioning high and low vacuum stage steam condensers one above the other but independent of each other similar to the case of FIG. 1. In this case, a water supplying tank 21 for the low vacuum stage steam condenser 6 is disposed between the high vacuum stage steam condenser 5 and the low vacuum stage steam condenser 6.

The operation of the multiple pressure stage steam condenser system thus constructed will now be described. Steam discharged by the double-flow turbine 3 is introduced both into the steam inlet 19 of the high vacuum stage steam condenser 5 and into the steam inlet 20 of the low vacuum stage steam condenser 6. Cooling water from the cooling tower is sprinkled into the steam condenser 5 through the water sprinkling board 17. During this operation, the steam flowing through the steam inlet 19 into the steam condenser 5 condenses into water. The mixture of the condensate thus formed and the cooling water from the cooling tower drops into the water supplying tank 21. That is, the mixture pools in the tank 21, the pooled water having a water level $\Delta H$. Since the water supplying tank 21 is formed on the water sprinkling board 17 of the lower steam condenser 6 as described above, the water in the water supplying tank 21 dropping through the water sprinkling board 17 and the trays 18 condenses the steam flowing through the steam inlet 20 into the lower steam condenser 6. Finally, the water reaches the hot well of the steam condenser 6 from which it is returned to the cooling tower. The water level $\Delta H$ of the pooled water is so selected, based on the difference between the pressures of the high vacuum stage steam condenser 5 and the low vacuum stage steam condenser 6 and the flow rate of cooling water supplied through the water sprinkling board 17, that a sealing action is effected and the cooling water is supplied at a predetermined flow rate.

As is apparent from the above description, in the multiple pressure stage steam condenser system according to the invention, the mixture of the cooling water and the condensate from the high vacuum stage steam condenser 5 positioned above the low vacuum stage steam condenser 6 is allowed to naturally drop so as to be supplied into the low vacuum stage steam condenser 6. Therefore, the system does not need an intermediate pressurizing pump as in FIG. 1. As the water supplying tank 21 is provided on the lower steam condenser 6, the water which drops from the upper steam condenser 5 and pools to the water level $\Delta H$ in the tank 21 performs the sealing action. That is, the pooled water provides a gas-tight seal between the high vacuum stage steam condenser 5 and the low vacuum stage steam condenser 6 between which a difference in pressure exists. Accordingly, the steam condensers 5 and 6 can be operated as required. In addition, the steam condensers 5 and 6 are arranged as shown in FIG. 2 one above the other in the common steam condenser barrel without providing a partition board between them. This feature, in addition to the elimination of the intermediate pressurizing pump mentioned above, makes the entire steam condenser system simpler in construction. Furthermore, the water supplying tank 21 is formed on top of the water sprinkling board 17 of the low vacuum stage steam condenser 6 according to the invention. This is advantageous in that the water pooled in the water supplying tank 21 separates the steam condensers 5 and 6 from one another with the cooling water supplied through the water sprinkling board 17 into the low vacuum stage steam condenser 6.

While the invention has been described with reference to a double pressure stage steam condenser system, the invention is not limited thereto or thereby. That is, the technical concept of the invention can be utilized to form a multiple pressure stage steam condenser having multiple pressure system in which more than two steam condensers are positioned one above the other.

Thus, the multiple pressure stage steam condenser system according to the invention has a variety of merits in that the intermediate pressurizing pump can be eliminated and, accordingly, the cost of equipment, the space needed for the installation and the power consumption can be much reduced and the operation has a high reliability.

What is claimed is:

1. A direct contact type multiple pressure stage steam condenser system comprising: a direct contact type high vacuum stage steam condenser and a direct contact type low vacuum stage steam condenser coupled to steam discharge outlets of a steam turbine and series-connected with each other, said high vacuum stage steam condenser being disposed above said low vacuum stage steam condenser; means for supplying cooling water into said upper high vacuum stage steam condenser, means for conducting away water discharged from said low vacuum stage steam condenser; and a water sprinkling board and a water supplying tank for said low vacuum stage steam condenser provided in an upper region thereof; said water supplying tank being formed as a water level on an upper surface of said water sprinkling board and being disposed between said high vacuum stage steam condenser and said low vacuum stage steam condenser such that a mixture of condensate formed in said high vacuum stage steam condenser and said cooling water drops into said water supplying tank and is supplied from said water supplying tank into said low vacuum stage steam condenser and that water is pooled in said water supplying tank and serves as sealing means to provide gas-tight separation between said high and low vacuum stage steam condensers.

2. The system as claimed in claim 1 in which said high vacuum stage steam condenser and said low vacuum stage steam condenser comprise as a single unit a steam condenser barrel, said high vacuum stage steam condenser and said low vacuum stage steam condenser occupying respectively upper and lower regions of said steam condenser barrel, and wherein said water supplying tank for said low vacuum stage steam condenser serves also as a hot well of said high vacuum stage steam condenser.

3. A direct contact type multiple pressure stage steam condenser system comprising: a direct contact type high vacuum stage steam condenser and a direct contact type low vacuum stage steam condenser coupled to steam discharge outlets of a steam turbine and series-connected with each other, said high vacuum stage steam condenser being disposed above said low vacuum stage steam condenser; means for supplying cooling water into said upper high vacuum stage steam condenser, means for conducting away water discharged from said low vacuum stage steam condenser; and a water sprinkling board and a water supplying tank for said low vacuum stage steam condenser provided in an upper region thereof, said water supplying tank being formed as a water level on an upper surface of said water sprinkling board and being disposed between said high vacuum stage steam condenser and said low vacuum stage steam condenser such that the condensate formed in said high vacuum stage steam condenser and said cooling water drop into said water supplying tank and are supplied from said water supplying tank into said low vacuum stage steam condenser and that water is pooled in said water supplying tank and serves as sealing means to provide gas-tight separation between said high and low vacuum stage steam condensers; said high vacuum stage steam condenser and said low vacuum stage steam condenser comprising as a single unit a steam condenser barrel, said high vacuum stage steam condenser and said low vacuum stage steam condenser occupying respectively upper and lower regions of said steam condenser barrel.

4. The system as claimed in claims 1 or 3 further comprising: a water sprinkling board provided in the upper region of said high vacuum stage steam condenser.

5. The system as claimed in claims 1 or 3 further comprising a plurality of trays disposed in each of said high vacuum stage steam condenser and said low vacuum stage steam condenser.

6. The system of claims 1 or 3, said water supplying tank having a selected water level based on the difference between the pressure of the high vacuum stage steam condenser and said low vacuum stage steam condenser and the flow rate of the cooling water supplied.

7. The system of claims 1 or 3 further including means for conducting away non-condensable gas.

* * * * *